United States Patent [19]

Limpaecher

[11] 4,258,753

[45] Mar. 31, 1981

[54] FLUIDIC SWITCH

[75] Inventor: Rudolf Limpaecher, Topsfield, Mass.

[73] Assignee: Avco Everett Research Laboratory, Inc., Everett, Mass.

[21] Appl. No.: 40,195

[22] Filed: May 18, 1979

[51] Int. Cl.[3] ..... F15C 1/12

[52] U.S. Cl. ..... 137/806; 137/815; 137/818; 137/834; 137/822

[58] Field of Search ..... 137/806, 815, 816, 818, 137/822, 823, 834

[56] References Cited

U.S. PATENT DOCUMENTS

| | | | |
|---|---|---|---|
| 3,267,948 | 8/1966 | Groeber | 137/815 |
| 3,348,562 | 10/1967 | Ogren | 137/806 |
| 3,390,611 | 7/1968 | Warren | 137/815 X |
| 3,468,328 | 9/1969 | Metzger | 137/815 |
| 3,570,512 | 3/1971 | Thompson | 137/840 |
| 3,690,337 | 9/1972 | Lagana | 137/803 |

*Primary Examiner*—William R. Cline

*Attorney, Agent, or Firm*—M. E. Frederick

[57] ABSTRACT

A fluidic amplifier or switch for supplying pulses of a power gas to be controlled which is insensitive to load impedance or back pressure. One arm of the fluidic switch comprising part of the gas injection path is coupled to a working outlet and the other arm is coupled through a sonic orifice to a vent outlet. An orifice is provided in the downstream end of the power gas injection path, the injection pressure is maintained at preferably at least about twice the maximum back pressure and a substitute gas is injected into the arm of the fluidic switch not carrying the power gas to be controlled. The two gases are each alternately supplied to the working outlet and the vent outlet. When the power gas to be controlled is supplied to the working outlet, the substitute gas is supplied to the vent outlet and when the substitute gas is supplied to the working outlet, the power gas to be controlled is supplied to the vent outlet to maintain the pressure constant across the working outlet orifice.

6 Claims, 2 Drawing Figures

FLUIDIC SWITCH

BACKGROUND OF THE INVENTION

Figure 1:
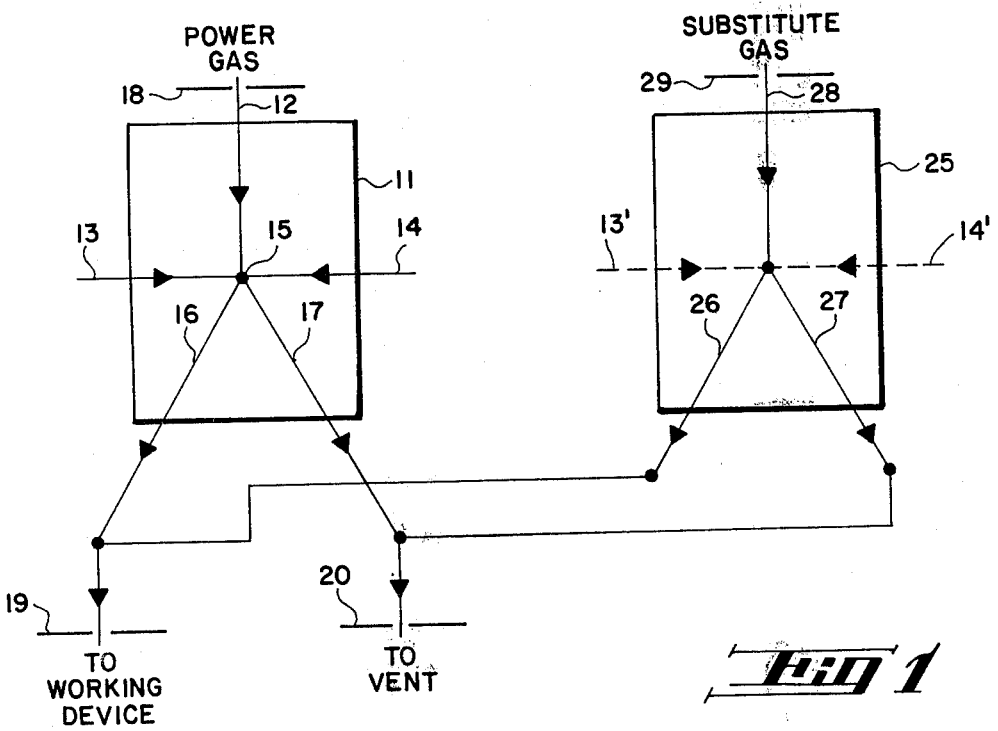

The invention described herein may be manufactured and used by or for the Government for Governmental purposes without the payment of any royalty thereon.

The present invention relates to fluidic switching apparatus and more particularly to back pressure insensitive fluidic switching apparatus for establishing controlled pressure pulses at high repetition rates.

PRIOR ART

Fluid amplifiers or switches having no moving parts except the operation fluid, or pure fluid amplifiers, are known in the art. They comprise generally a system of interconnected fluid channels arranged such that a fluid power stream may be switched from one output channel to another by means of one or more fluid control streams each of which has less momentum than the power stream.

Fluid amplifiers of both the momentum exchange and the boundary layer control types are very sensitive to back loading or back pressure. With back loading or back pressure here is meant the pressure influence on the operation of the amplifier of load devices connected to its output channels. Such back loading causes pressure differences across the power stream followed by disturbances or instability in the flow pattern of the power stream.

For example, in an atmospheric, repetitively pulsed subsonic flow hydrogen-fluorine-reaction-to-hydrogen-fluoride laser, the gases must be mixed upstream of the lasing region and remain unreacted until the volumetric initiation. For high electrical efficiency and high mass utilization, it is necessary that the flow of the $H_2$ ($D_2$) or the $F_2$ be briefly turned off in order to obtain flameout after each initiation. Further, good optical medium homogeneity throughout the laser medium is desired at the time of initiation.

Removal of the hydrogen creates an uncombustible mixture and gas injection during the time combusted gas is being flushed is not useful to provide a good optical lasing medium. Gas which enters the laser during the time the hydrogen flow turns on or off is of no lasing value. Accordingly, the turn-on and turn-off period should be a small fraction of the laser interpulse duration. The use of controlled fluidic devices best meets the above noted system requirements. However, the substantial differences in back pressure as, for example, the substantial fluctuation in back pressure upon initiation renders the use of conventional fluidic devices unsatisfactory.

SUMMARY OF THE INVENTION

In accordance with the present invention, such above-noted fluctuations in back pressure may be overcome by providing in a fluidic amplifier or switch an orifice in the gas injection path for the gas to be controlled, raising the injection pressure of the gas to be controlled and injecting a "substitute" gas in the arm of the fluidic switch not carrying the gas to be controlled to maintain the pressure constant across the orifice in the gas injection path.

While application to a chemical laser has been described above merely by way of example, the invention is not so limited and may be used in other applications.

It is an object of the invention to make gas injection (and/or cut off of gas injection) with fluidic switching apparatus less sensitive to back pressure fluctuations.

It is a further object of the invention to provide fluidic switching apparatus insensitive to back loading.

It is a further object of the invention to provide economic and reliable apparatus for achieving the foregoing objects and in particular limiting usage of moving parts.

Figure 2:
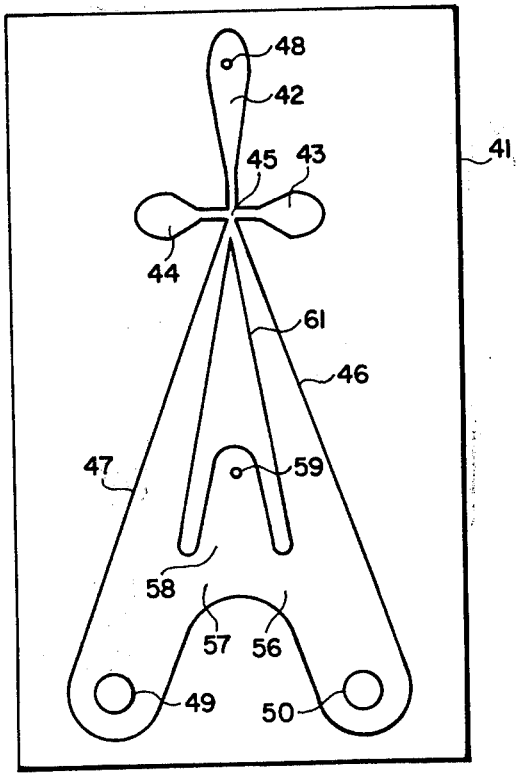

Other objects, features and advantages of the invention will be apparent from the following detailed description with reference to the accompanying drawings in which:

FIG. 1 is a schematic diagram of a fluidic circuit constructed in accordance with the invention; and FIG. 2 illustrates a simplified embodiment of the schematic diagram of FIG. 1.

Referring now to FIG. 1, there is shown in schematic form a conventional fluidic amplifier enclosed by the block 11 including a power gas input passage 12, control gas passages 13 and 14, an interaction chamber 15 intermediate control gas passages 13 and 14, and reception channels or passages 16 and 17. The power gas input passage 12 is coupled through a sonic orifice 18 for mass flow regulation purposes to a source of pressurized power gas (not shown) and control gas passages 13 and 14 are coupled to a controlled conventional fluidics oscillator or the like (not shown) for controllably switching the flow of the power gas as desired or required. Such oscillators and the like for controlling fluidic switches are well-known and do not require description here.

Reception channel or passage 16 comprising part of the power gas injection path is coupled to a working region through preferably a sonic orifice 19 and reception channel or passage 17 is vented as to the atmosphere through preferably a sonic orifice 20.

A second fluidic switch is shown enclosed by the block 25. This second fluidic switch is similar to switch 11 except that the control passages may be omitted. While both switches may be controlled in parallel by the same signals as indicated by (dashed) control gas passages 13' and 14', control of switch 25 is not necessary if switch 11 is of the well-known high pressure recovery and high stability type, while switch 25 is of the low pressure recovery and low stability type. For this arrangement, control of switch 11 dominates and will force back pressure switching of switch 25.

Reception channel or passage 26 is coupled to reception channel or passage 16 in the power gas injection path upstream of orifice 19 and reception channel or passage 27 is coupled to the reception channel or passage 17 of the fluidic amplifier 11 upstream of orifice 20. Input passage 28 of the second fluidic switch 25 is coupled through preferably a sonic orifice 29 for mass flow regulation purposes to a pressurized source of a "substitute" gas (not shown).

In order to understand the operation of the system illustrated in FIG. 1, assume that the power gas source is supplying power gas to the interaction chamber 15 of switch 11. If a control stream is directed from the right hand control passage 14 into the interaction chamber 15, it will cause the power stream to be displaced into the reception channel 16 and attach to a wall thereof in conventional manner. The power stream flows from reception channel 16 through the orifice 19 and into the working device. The initial pressure of the power gas and substitute gas is selected to be such that the pressure on the upstream side of orifice 19 and orifice 20 is substantially the same and preferably at least about twice the maximum occurring in the working device. When at least this pressure ratio exists, there will also exist minimum, if any, adverse effect on the fluidics and a minimum, if any, effect on mass flow through orifice 19 for changes in pressure in the working region. It is to be understood that, depending on the application, where some mass flow variation can be tolerated, the pressure ratio across orifice 19 may be reduced below the sonic operating condition. Because of the pressure recovery relationship of the two switches, the substitute gas is supplied to switch 25 at the appropriate pressure depending on the density of the gases, and is caused to flow through reception channel 27 and in part into reception channel 17 of switch 11, the balance being vented. The pressures in the reception channels of switch 11 are substantially the same due to the presence of the substitute gas.

When a control pulse is supplied to the left hand control passage 13 of switch 11, the power stream in conventional manner is caused to immediately switch to reception channel 17 and be vented. This simultaneously causes the substitute gas in switch 25 to switch to reception channel 26 and thence in part into reception channel 16 of switch 11 with the majority flowing into the working device. Variations in pressure in the working device do not affect the switching operation due to the maintenance in accordance with the invention of an effectively constant pressure ratio across sonic orifice 19.

Directing attention now to FIG. 2 which is a simplified embodiment of the schematic diagram of FIG. 1, a fluidic switch 41 in accordance with the invention is shown, including a power gas input passage 42, control gas passages 43 and 44, an interaction chamber 45, and reception channels 46 and 47. The power gas input passage 42 is coupled through preferably a sonic orifice 48 to a source of pressurized power gas and control gas passages 43 and 44 are coupled to a controlled conventional fluidics oscillator or the like, all as described in connection with FIG. 1.

Reception channel 47 forms part of the power gas injection path and is coupled to a working region through preferably sonic orifice 49. Reception channel 46 is vented through preferably sonic orifice 50. The second switch 25 of FIG. 1 is incorporated in the following manner. The reception channels 46 and 47 are enlarged at the downstream ends adjacent the orifices 49 and 50 and formed to provide centrally located reception channels 56 and 57 communicating with the substitute gas interaction chamber 58 formed as a recess in the flow divider 61. A preferably sonic orifice 59 is provided at the upper end of chamber 58. Thus, substitute gas entering at orifice 59 may flow through chamber 58 and thence through channels 56 or 57 towards either orifice depending on which of reception channels 47 or 46 is carrying the power gas, all as described in connection with FIG. 1.

Operation of a fluidic switch in accordance with the present invention has shown it to operate in the manner disclosed herein. The power gas was supplied to the working region through the power gas injection path without any substantial inclusion of the substitute gas, and when the flow was switched, all of the power gas was vented.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims:

I claim:

1. A fluidic switch comprising:

(a) a first interaction chamber;

(b) first means for issuing a first deflectable continuous jet of fluid to be controlled under pressure through said first interaction chamber;

(c) first and second reception channels having entrances from said first interaction chamber and located to receive said first continuous jet selectively according to the direction of flow of said first continuous jet;

(d) first and second control means disposed in opposed relationship adapted to controllably issue streams of fluid impacting against said first continuous jet to deflect said first continuous jet to selectably flow into one or the other of said first and second reception channels;

(e) first and second orifices for receiving fluid flow from respectively said first and second reception channels;

(f) a second interaction chamber;

(g) second means for issuing a second deflectable continuous jet of substitute fluid under pressure through said second interaction chamber;

(h) third and fourth reception channels having entrances from said second interaction chamber and located to receive said second continuous jet selectably according to the direction of flow of said second continuous jet, the exit of said third reception channel being coupled to said first reception channel and the exit of said fourth reception channel being coupled to said second reception channel; and (i) flow control means effective to deflect said second continuous jet of substitute fluid in such direction that said second continuous jet of substitute fluid flows into said third reception channel when said first continuous jet of fluid flows into said second reception channel, and said second continuous jet of substitute fluid flows into said fourth reception channel when said first continuous jet of fluid flows into said first reception channel, whereby when said second jet of substitute fluid flows substantially only through one of said orifices, said first jet of fluid flows substantially only through the other of said orifices.

2. The apparatus of claim 1 wherein said first interaction chamber, said first and second reception channels and said first and second control means are configured as a high pressure recovery and high stability switch; said second interaction chamber and said third and fourth reception channels are configured as a low pressure recovery and low stability switch; and said flow control means, effective to deflect said second continuous jet, comprises said couplings, between said third reception channel and said first reception channel, and between said fourth reception channel and said second reception channel.

3. The apparatus of claim 1 wherein said first and second reception channels are divergent and lie substantially in a plane, defining a generally triangular planar region therebetween, and said second interaction chamber is located substantially within said region.

4. The apparatus of claim 1 wherein said first and second reception channels are divergent and lie substantially in a plane, defining a generally triangular planar region therebetween and said second interaction chamber is located substantially outside said region.

5. The apparatus of claim 4 and additionally including third and fourth control means to controllably issue streams of fluid impacting against said second jet whereby when said first jet flows substantially only through one of said orifices, said second jet is caused to flow substantially only through the other of said orifices.

6. The apparatus of claim 1 wherein said first and second orifices are sonic orifices and said first and second means for issuing a deflectable continuous jet of fluid cause said jets to issue through their respective said interaction chambers at about twice the pressure on the outlet sides of said first and second orifices.

* * * * *